US006195815B1

(12) United States Patent
Wilkinson et al.

(10) Patent No.: US 6,195,815 B1
(45) Date of Patent: Mar. 6, 2001

(54) UNIT FOR A SHOWER

(75) Inventors: Andrew David Wilkinson; Alan Percy Fowle, both of North Yorkshire (GB)

(73) Assignee: Taplanes Limited, North Yorkshire (GB)

( * ) Notice: Subject to any disclaimer, the term of this patent is extended or adjusted under 35 U.S.C. 154(b) by 0 days.

(21) Appl. No.: 09/426,732

(22) Filed: Oct. 26, 1999

(30) Foreign Application Priority Data

Oct. 26, 1998 (GB) ..... 9823343

(51) Int. Cl.[7] ..... A47K 3/30
(52) U.S. Cl. ..... 4/604; 4/560.1
(58) Field of Search ..... 4/604, 605, 611, 4/560.1, 578.1

(56) References Cited

U.S. PATENT DOCUMENTS 3,028,603 * 4/1962 Rodman ..... 4/584 X
3,090,969 * 5/1963 Maling ..... 4/611
4,091,479 * 5/1978 Hancock ..... 4/560.1
4,168,549 * 9/1979 Davies ..... 4/578.1
4,253,202 3/1981 Thomas .
4,680,817 * 7/1987 Sloan et al. ..... 4/556
5,337,525 8/1994 Zaccai et al. .
5,606,751 3/1997 Baker .

FOREIGN PATENT DOCUMENTS

2671961 * 7/1992 (FR) ..... 4/604

* cited by examiner

*Primary Examiner*—Charles E. Phillips
(74) *Attorney, Agent, or Firm*—Jenkins & Wilson, P.A.

(57) ABSTRACT

Apparatus for facilitating use of a shower is described. The apparatus comprises support means and shuttle means slidably mounted on the support means. In use, the shuttle means is slidably movable along the support means between a first position adjacent a shower and a second position remote from the shower.

A shower curtain for use with the shuttle and support is also described. A footwell is adapted to ease use by an attendant.

8 Claims, 6 Drawing Sheets

UNIT FOR A SHOWER

The present invention relates to a unit for a shower and, in particular, to apparatus for facilitating use of a shower by a disabled person.

Disabled persons such as geriatric, sick or post-operative persons can be unsteady and often need to sit while having a shower. Persons who normally use a wheelchair also generally need to sit while showering. In general, the disabled person is wheeled into the shower on a wheelchair, for example by hospital staff for assisted showering.

The present invention has been made from a consideration of the disadvantages with use of a wheelchair or the like in a shower and in order to provide an apparatus which facilitates use of a shower by a disabled person and which facilitates assisted showering.

According to the present invention there is provided apparatus for facilitating use of a shower comprising support means and shuttle means slidably mounted on said support means such that, in use, said shuttle means is slidably movable along said support means between a first position adjacent a shower and a second position remote from said shower.

Preferably, said support means comprises an elongate panel. Typically, the panel is adapted to be mounted with its longer edges substantially horizontal. Preferably, the panel comprises polypropylene with a metal backing plate such as stainless steel. Typically the panel is adapted to be mounted on a wall by suitable means such as brackets and, in use, may extend from the interior of a shower cubicle to project outside the cubicle. Preferably, the panel is in two sections, an interior section and an exterior section having a small gap therebetween. Such a gap is typically sufficiently small not to interfere with the sliding movement of the seat means. The gap may be adapted to receive a portion of a shower curtain means.

Preferably, the shuttle means comprises a shuttle adapted to be slidably mounted on said support means and a seat extending substantially horizontally from said shuttle. The seat may be removably secured to said shuttle. Preferably, arm-rests and/or a back-rest are also removably secured to the shuttle. Preferably, the height of the seat and/or the arm-rests and back-rest are adjustable to accommodate different sized users. Preferably, the shuttle comprises front and back panels which respectively extend downwardly on each side of the support panel, the seat being secured to the front panel. Preferably, the front panel extends down the support panel substantially as far as the region from which the seat extends in use and the back panel extends only partially down the support panel. Preferably, the front panel is a relatively long panel and the back panel is a relatively short panel. Preferably, bearing means on the front surface of the back panel engage the upper region of the support panel and bearings means on the back surface of the front panel engage the lower region of the support panel. Preferably, the bearing means on the front panel is located on the opposite side but in the same region as, when in use, the seat of the shuttle. Preferably, the seat of the shuttle is secured and extends from, in use, the said front panel. Preferably, the shuttle means engages the support means by means of bearing means on the front panel, back panel and spacer element. Preferably, the bearing means are roller bearings. Preferably, a spacer element is sandwiched between the upper regions of the front and back panels. Preferably, in use, the spacer element overlies an upper edge of the support panel. Preferably, a back surface of the front panel is provided with one or more roller bearings, typically spaced at intervals in a row along a lower region of the front panel. Preferably, a front surface of the back panel is provided with one or more roller bearings, typically spaced at intervals in a row along a lower region of the back panel. Such bearing may be mounted in corresponding recesses in the front and back panels. Preferably, the bearing axes extend vertically in use. Preferably, the spacer element comprises one or more recesses formed in a lower edge thereof, typically spaced at regular intervals along said edge. Preferably, one or more roller bearings are mounted transversely between said front and back panels and typically extend into corresponding edge recesses in said spacer element such that in use the shuttle slides along the support panel by means of such rollers.

The invention includes a shower cubicle having apparatus of the invention installed thereon. Preferably, the support panel extends both inside and outside the cubicle. Preferably, the cubicle comprises a shower tray or floor section which is raised above ground level. Preferably, a recess or footwell is provided beneath the tray or floor section with an opening to the front of the cubicle to allow an assistant to stand with his feet beneath the shower tray/floor thereby facilitating better access during assisted showering and closer proximity to the person being showered.

According to a second aspect of the invention there is provided a shower cubicle having a shower tray or floor section raised above ground level wherein a recess or footwell is provided beneath the tray or floor section, such recess or footwell having an opening to the front of the cubicle for receiving a user's feet.

According to a third aspect of the invention there is provided a shower cubicle having a curtain rail pivotally secured to one side of said cubicle adjacent a cubicle opening. Preferably, the rail is secured by means of a pivotal hinge. Preferably, the rail is adapted to pivot between a stored position, typically upright, and an extended position wherein the rail spans the cubicle opening. Preferably, the pivotal connection is at a height on the cubicle such that when in the extended position the rail extends at substantially the height of the shoulders of a user seated in the shower cubicle. Preferably, a half height or corresponding height curtain is mounted on the rail to extend between the rail and the floor of the cubicle.

Preferably, the curtain comprises a stiffened edge. Preferably the stiffened edge of the curtain is the edge remote from the pivotal connection of the rail. The cubicle may include apparatus of the invention installed thereon.

The invention will now be described further by way of example only and with reference to the accompanying drawings in which.

Figure 1:
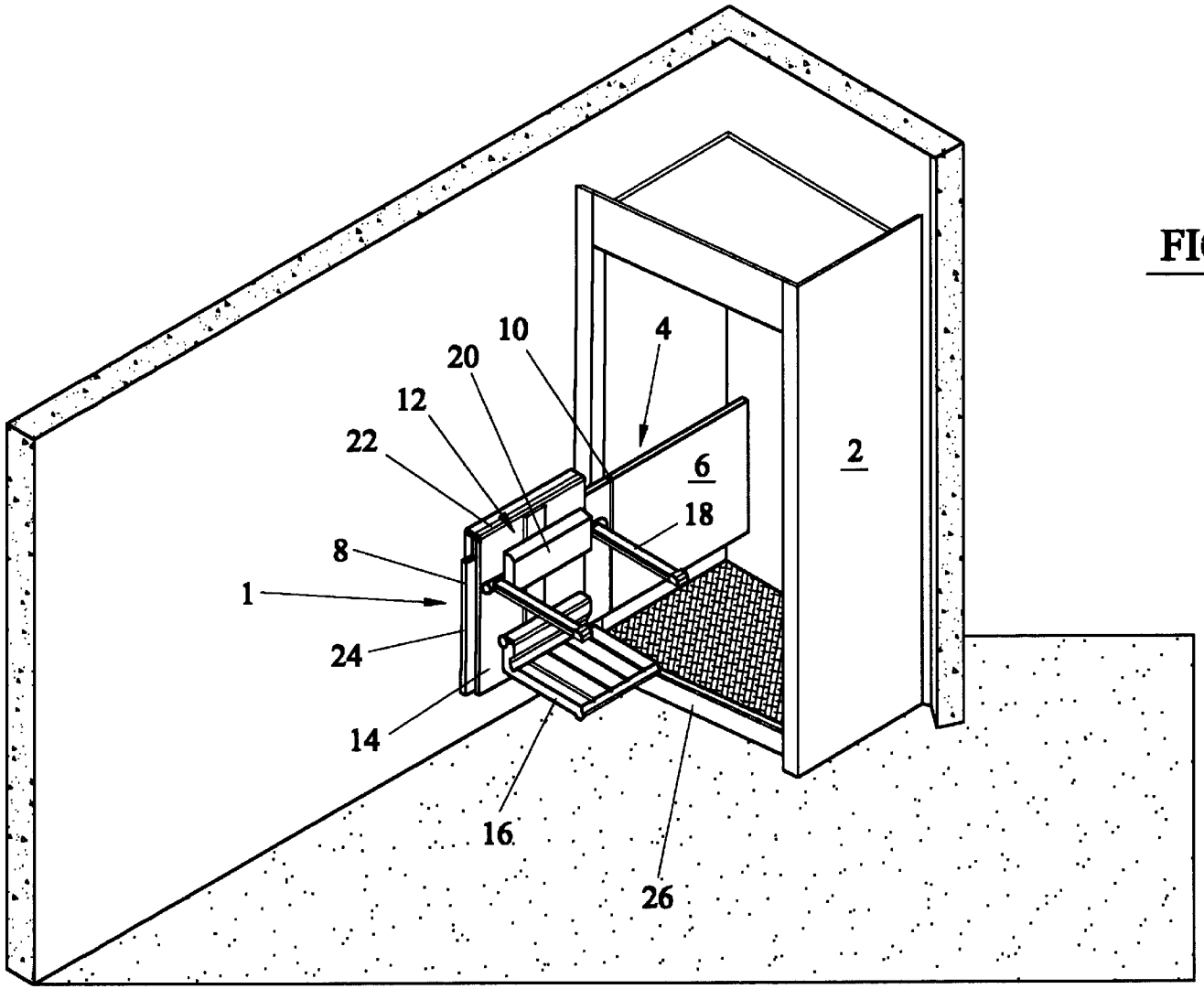
FIG. 1 is a perspective view of apparatus of the invention installed in a shower.
Figure 4:
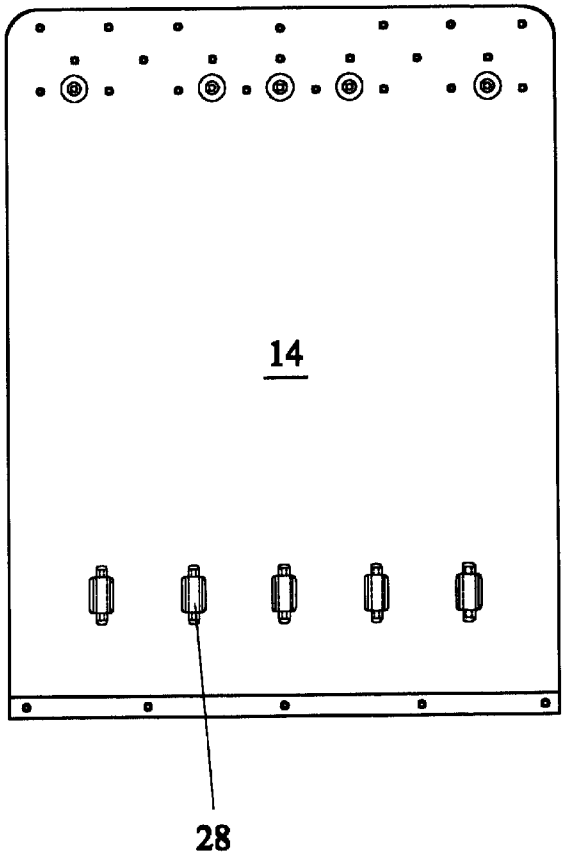
FIG. 4 is a front view of a shuttle front panel.
Figure 5:
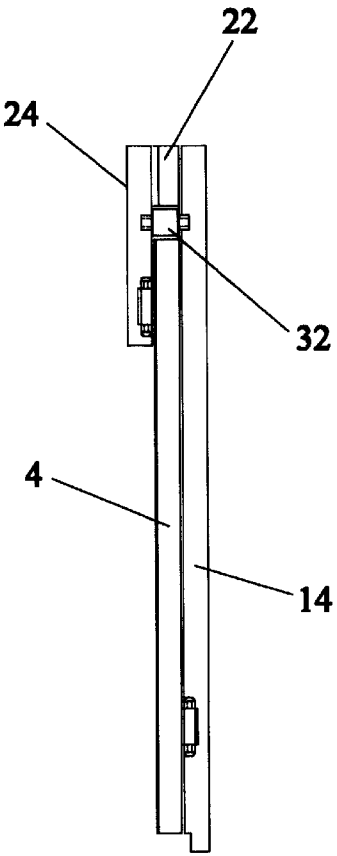
FIG. 5 is a side view of a shuttle mounted on a support means.

Referring to FIG. 1, apparatus of the invention 1 is shown installed in a shower cubicle 2. The apparatus includes a support panel 4 which comprises a first section 6 mounted on an interior wall of the cubicle 2 by suitable brackets and a second section 8 mounted on a wall outside the cubicle 2 by suitable brackets. The first and second sections are substantially co-planar with a small gap 10 therebetween to accommodate a shower curtain as described below. A shuttle 12 is slidably mounted on the support panel 4 and slides along the upper edge of the panel 4. The shuttle comprises a front plate 14 which supports a removable seat 16, arm-rests 18 and back-rest 20. The heights of the seat, arm-rests and back-rest can be adjusted as required by sliding vertically relative to the front plate 14. The shuttle has a spacer element 22 which overlies the upper edge of the support panel 4, in use, and spaces the front plate 14 from a back plate 24. Thus, part of the support panel is sandwiched between the front and back plates. In use, the seat and shuttle are slidably movable between a first position adjacent the shower, typically inside a shower cubicle, and a second position remote from the shower, typically outside a shower cubicle as shown in FIG. 1. Typically, the support panel 4 is adapted to be mounted at a height to facilitate its use as a hand rail for unassisted showering. The shower cubicle includes a recessed footwell 26 to allow for closer working during assisted showering.

Figure 3:
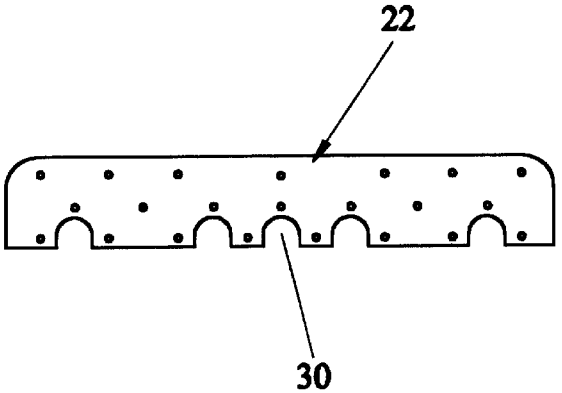
FIG. 3 is a front view of a shuttle spacer.
Figure 2:
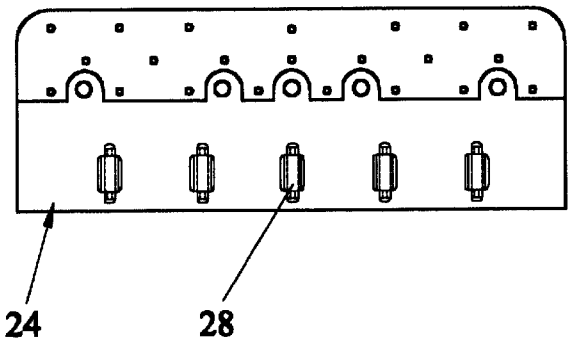
FIG. 2 is a front view of a shuttle back panel.

Referring to FIGS. 2 to 5, the shuttle 12 is shown in more detail. The front plate 14 extends down the full width of the support panel 4 and has a plurality of roller bearings 28 mounted in corresponding recesses in the back surface thereof. The bearings are spaced apart, typically at regular intervals, and are typically located in a row adjacent a lower region of the front panel 14. The back plate 24 is a short panel which overlies an upper region of the support panel 4 and has a similar row of bearings 28 located in corresponding recesses along a front surface thereof. The bearings 28 assist the sliding movement of the shuttle along the support panel 4 and act to counteract any torque exerted by the seat occupant. The upper regions of the front and back plates are secured to a spacer element 22 which overlies the upper edge of the support panel 4 in use. The spacer element has a plurality of recesses 30 spaced apart along a lower edge thereof. The recesses 30 may be spaced at regular intervals or at varying intervals, for example as shown in FIG. 3. The recesses 30 accommodate roller bearings 32 which extend transversely between the front and back panels 14, 24. The respective ends of the bearings 32 are mounted in the front and back panels and, in use, the shuttle slides along the support panel by means of the rollers 32.

Figure 6:
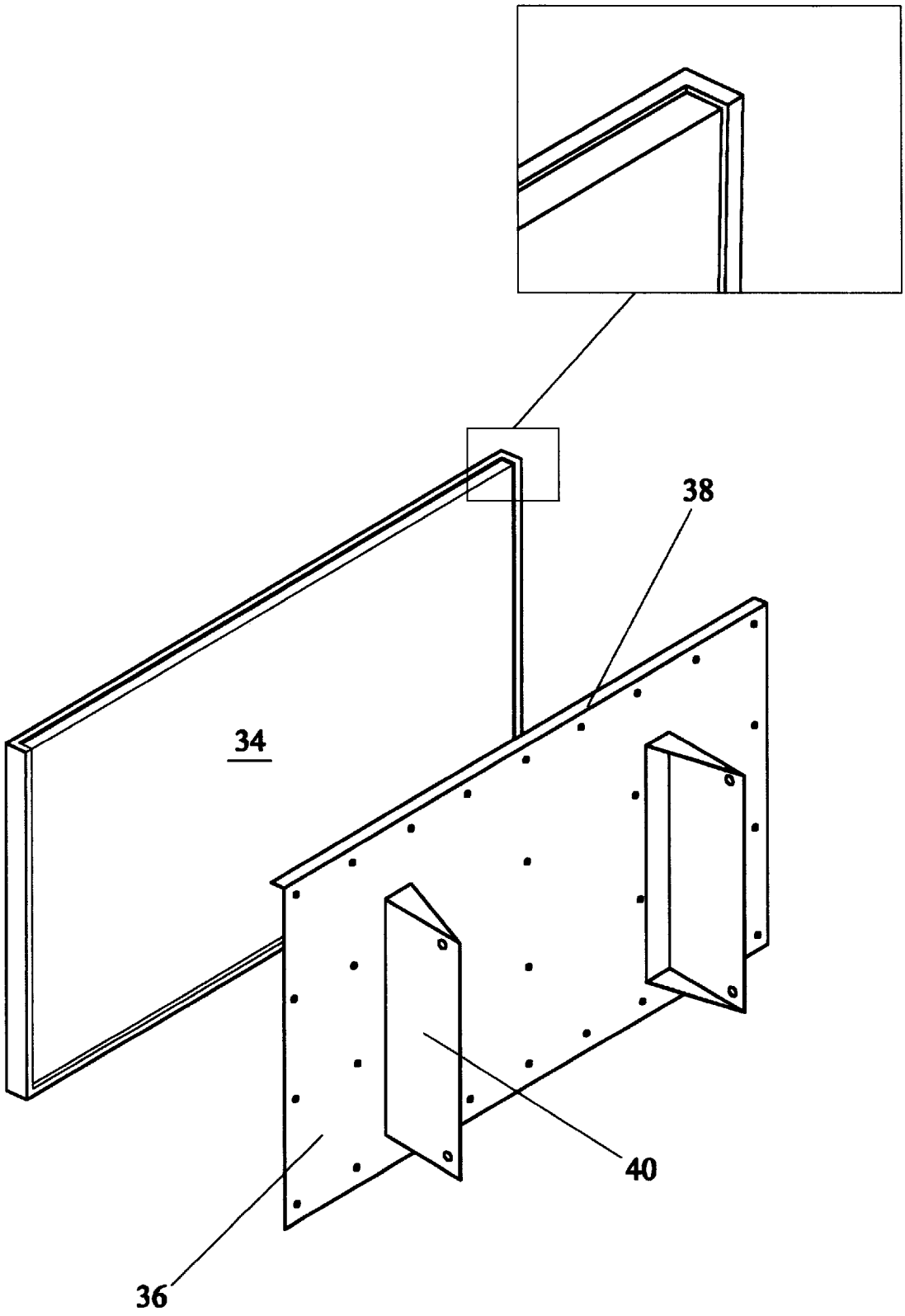
FIG. 6 is a perspective view of a support panel.
Figure 7:
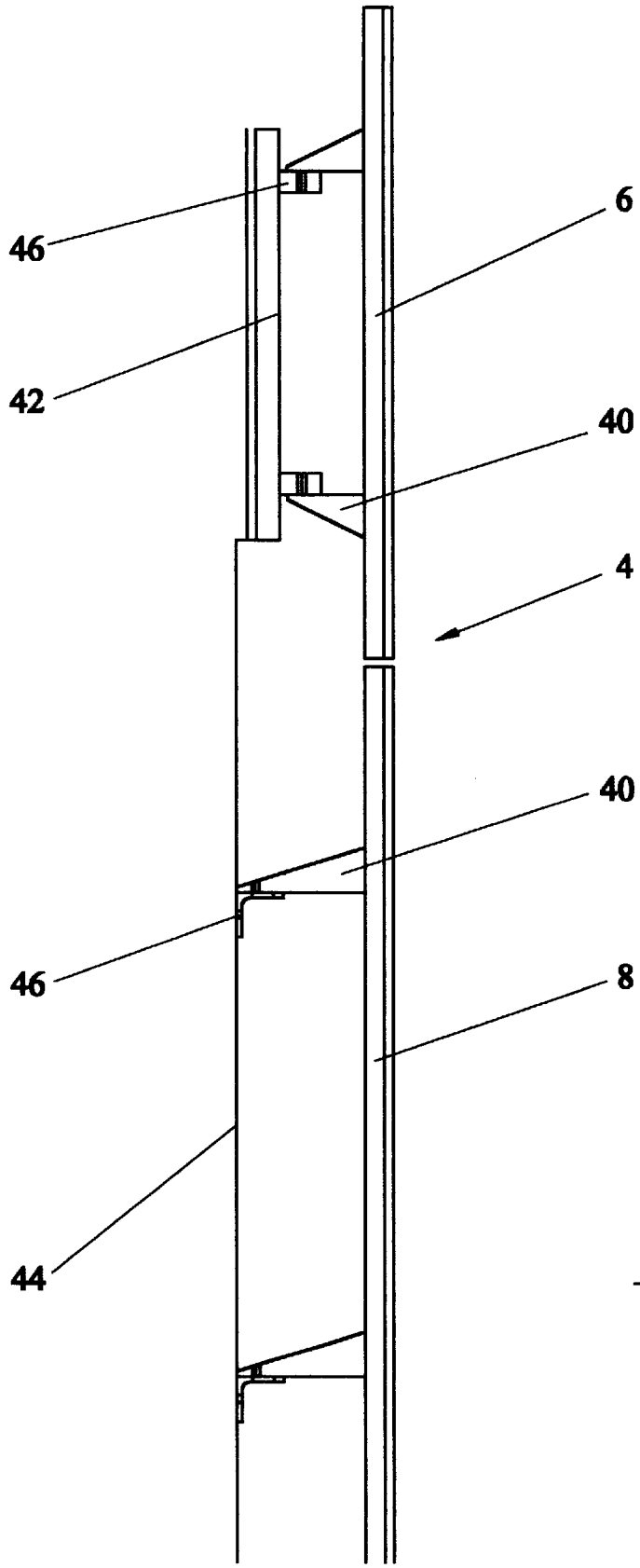
FIG. 7 is a plan view of a support panel mounted to a wall.

Referring to FIG. 6, typically the support panel 4 comprises a polypropylene board 34 with a metal, such as stainless steel, backing plate 36 and top edge plate 38. Mounting brackets 40 typically of metal are secured to the back of the backing plate 36, by spot welding or otherwise and facilitate wall mounting of the support panel 4 at a given spacing from the wall to accommodate the sliding shuttle. FIG. 7 shows the two sections of a support panel 4 mounted to the interior 42 and exterior 44 walls of a shower cubicle by suitable mounting brackets 40 and wall mounted support brackets 46. It will be appreciated that any suitable mounting means or brackets may be used.

Figure 8:
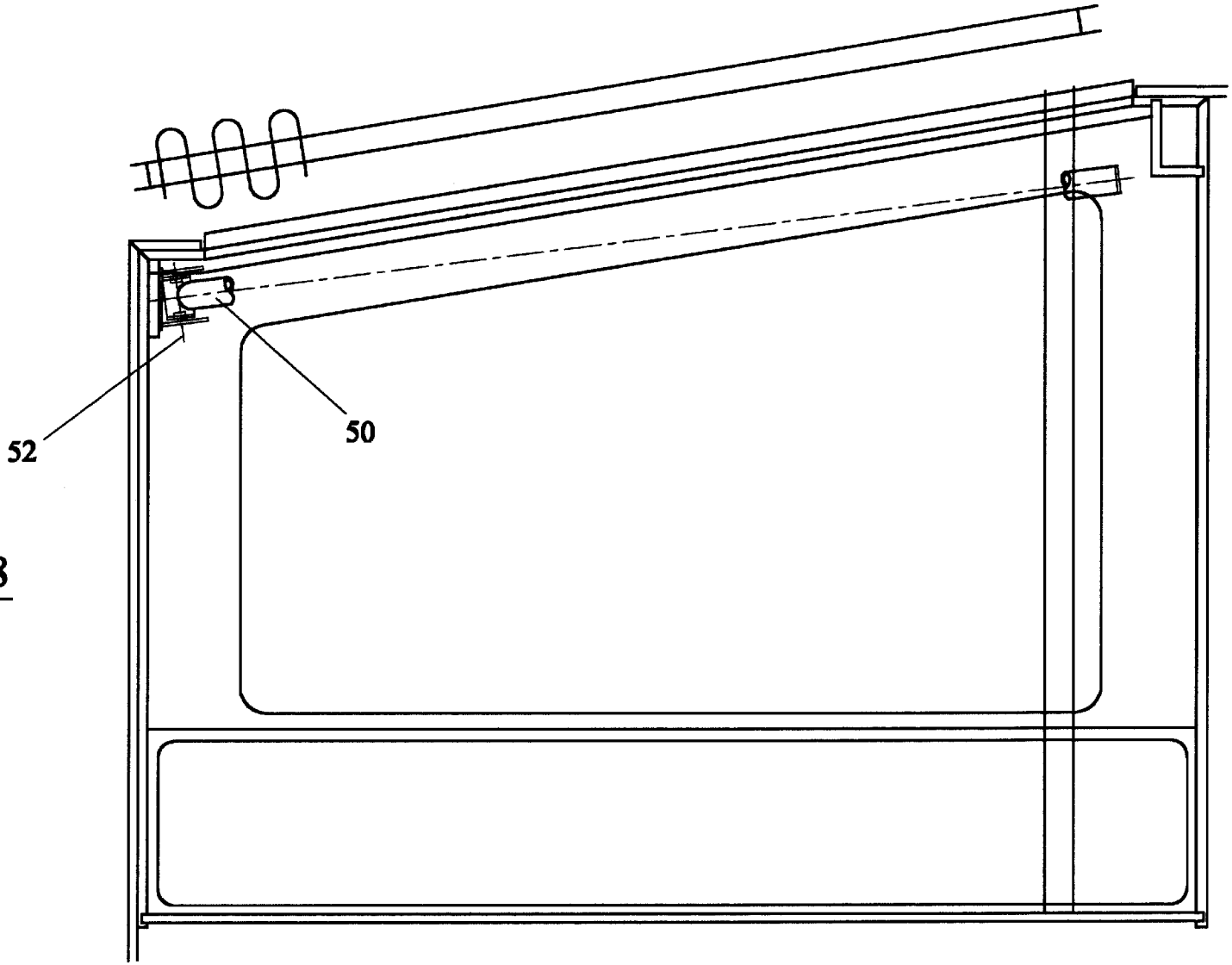
FIG. 8 is a plan view showing a curtain rail mounted in a shower cubicle.
Figure 9:
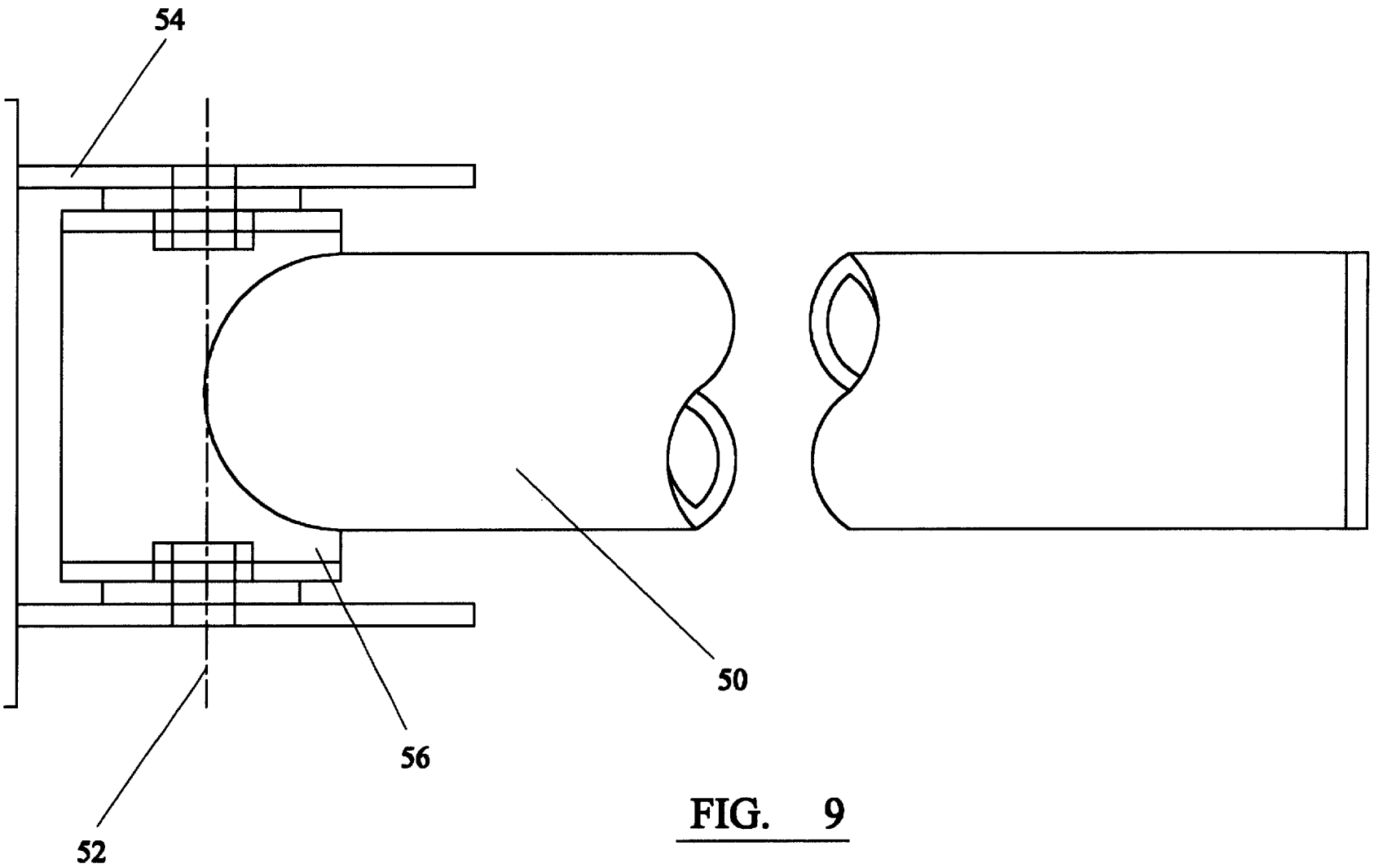
FIG. 9 is a detailed view of a curtain rail and mounting bracket corresponding to FIG. 9.

Referring to FIGS. 8 and 9, a shower curtain arrangement comprises a curtain rail 50 adapted to be pivotally mounted at one side of a shower. One end of the rail 50 is pivotable about a substantially horizontal axis 52. In use, the rail is stored in an upright or vertically extending position and is pivoted down to extend across a shower opening. Thus, when the rail is in the stored position, it does not inhibit sliding of the seat means into the shower area and, once the seat means is in the shower area, the rail can be pivoted down to extend across the shower opening. A half height curtain is mounted on the rail and can be drawn across the rail when the latter is in the extended position. The rail is typically mounted on the side of a cubicle opposed to the side at which the support means is mounted and at a height such that when the rail extends across the opening it is substantially at the height of a user's shoulders. Such a curtain arrangement allows privacy for the user while maintaining safety by allowing the user's head to be seen. Typically the curtain is provided with a stiffened edge, that is the edge which is drawn towards the support panel 4, so that, in use, the stiffened edge can be located in the gap 10 provided in the support panel thereby allowing complete privacy.

When the rail is in the stored position, the curtain hangs from the pivotal end of the rail and as such does not obstruct the use of the shuttle. A suitable pivotal hinge for supporting the pivotal end of the curtain rail 50 is shown in FIG. 9 and comprises a wall mounted bracket 54 having two transverse arms which support a pivotal member 56 to which an end of the rail 50 is secured.

The reader's attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. Apparatus for facilitating use of a shower comprising support means and shuttle means slidably mounted on said support means such that, in use, said shuttle means is slidably movable along said support means between a first position adjacent a shower cubicle and a second position remote from said shower cubicle, said shower cubicle having an inside and an outside, characterised in that said support means extends from the inside of said shower cubicle to project outside said shower cubicle so that a user may be moved in and out of said shower cubicle supported by said shuttle means, wherein:

said support means comprises an elongate panel, and the elongate support panel is adapted to be mounted with its longer edges substantially horizontal, and said shuttle means comprises front and back panels which respectively extend downwardly on each side of the elongate support panel, with a seat being secured to the shuttle front panel.

2. A shower cubicle having an apparatus according to claim 1, wherein said shower cubicle has a shower tray or floor section raised above ground level wherein a recess or footwell is provided beneath the tray or floor section, and said shower cubicle has a front and the recess or footwell has an opening to the front of said shower cubicle for receiving a user's feet.

3. Apparatus according to claim 1, wherein the apparatus further includes a tray or floor section, and said shower cubicle has a front, and a recess or footwell is provided beneath the tray or floor section with an opening to the front of said shower cubicle to allow an assistant to stand with his feet beneath the shower tray/floor thereby facilitating better access during assisted showering and closer proximity to a user being showered.

4. Apparatus according to claim 1, wherein said shuttle means is slidably mounted on the elongate support panel.

5. Apparatus according to claim 1, wherein the shuttle front panel extends relatively further down the elongate support panel compared with the shuttle back panel.

6. Apparatus according to claim 5, wherein the shuttle back panel has a front surface, the elongate support panel has a back surface, and the shuttle front panel has a front surface and a back surface, and wherein bearing means on the front surface of the shuttle back panel engage an upper region of the back surface of the elongate support panel and bearing means on the back surface of the shuttle front panel engage a lower region of the back surface of the elongate support panel.

7. Apparatus according to claim 6, wherein the shuttle front and back panels each has an upper region and a spacer element is sandwiched between the upper regions of the shuttle front and back panels.

8. Apparatus according to claim 6, wherein the bearing means on the back surface of the shuttle front panel is located on the opposed side, but in a region that is the same as that, from which the seat of the shuttle extends in use.

* * * * *